US006013018A

United States Patent [19]

Bannister

[11] Patent Number: 6,013,018

[45] **Date of Patent: *Jan. 11, 2000**

[54] SONIC VALVE CLOSURE ASSEMBLY FOR VALVE BAGS

[75] Inventor: Roger Bannister, Crossett, Ark.

[73] Assignee: Bemis Company, Inc., Vancouver, Wash.

[ * ] Notice: This patent is subject to a terminal disclaimer.

[21] Appl. No.: 09/010,861

[22] Filed: Jan. 22, 1998

Related U.S. Application Data

[63] Continuation-in-part of application No. 08/906,463, Aug. 5, 1997

[60] Provisional application No. 60/025,462, Sep. 5, 1996.

[51] Int. Cl.[7] ..... B65D 30/24

[52] U.S. Cl. ..... 493/102

[58] Field of Search ..... 493/102; 383/44–46, 383/48, 54, 115

[56] References Cited

U.S. PATENT DOCUMENTS

| | | | |
|---|---|---|---|
| 2,147,970 | 2/1939 | Du Bois | 383/53 |
| 3,130,897 | 4/1964 | Poklukar et al. | 383/46 |
| 3,191,850 | 6/1965 | Niemeyer | 229/625 |
| 3,261,267 | 7/1966 | Becker | 383/46 X |
| 4,049,191 | 9/1977 | Stearley | 383/46 |
| 4,367,620 | 1/1983 | Fox | 53/479 |
| 4,391,404 | 7/1983 | Welter | 383/46 |
| 4,453,270 | 6/1984 | Donni et al. | 383/115 |
| 4,759,640 | 7/1988 | Groner | 383/44 |
| 4,930,904 | 6/1990 | Groner et al. | 383/45 |
| 5,071,699 | 12/1991 | Pappas et al. | 383/117 X |
| 5,516,210 | 5/1996 | Kelley et al. | 383/54 |

FOREIGN PATENT DOCUMENTS

| | | |
|---|---|---|
| 34 606 | 10/1971 | Austria . |
| 2 228 004 | 4/1974 | France . |
| 2 218 867 | 4/1972 | Germany . |
| 3 203 187 | 8/1983 | Germany . |

*Primary Examiner*—David A. Scherbel
*Assistant Examiner*—Anthony Ojini
*Attorney, Agent, or Firm*—Lee, Mann, Smith, McWilliams, Sweeney & Ohlson

[57] ABSTRACT

The present invention is a valve bag with a valve assembly that provides closure during and after the filling process, thus preventing unwanted spilling and sifting of the valve bag contents through the valve opening during transporting or moving the bag to a location in which the valve is permanently sealed, and methods for making and filling such a bag.

12 Claims, 9 Drawing Sheets

FIG.16
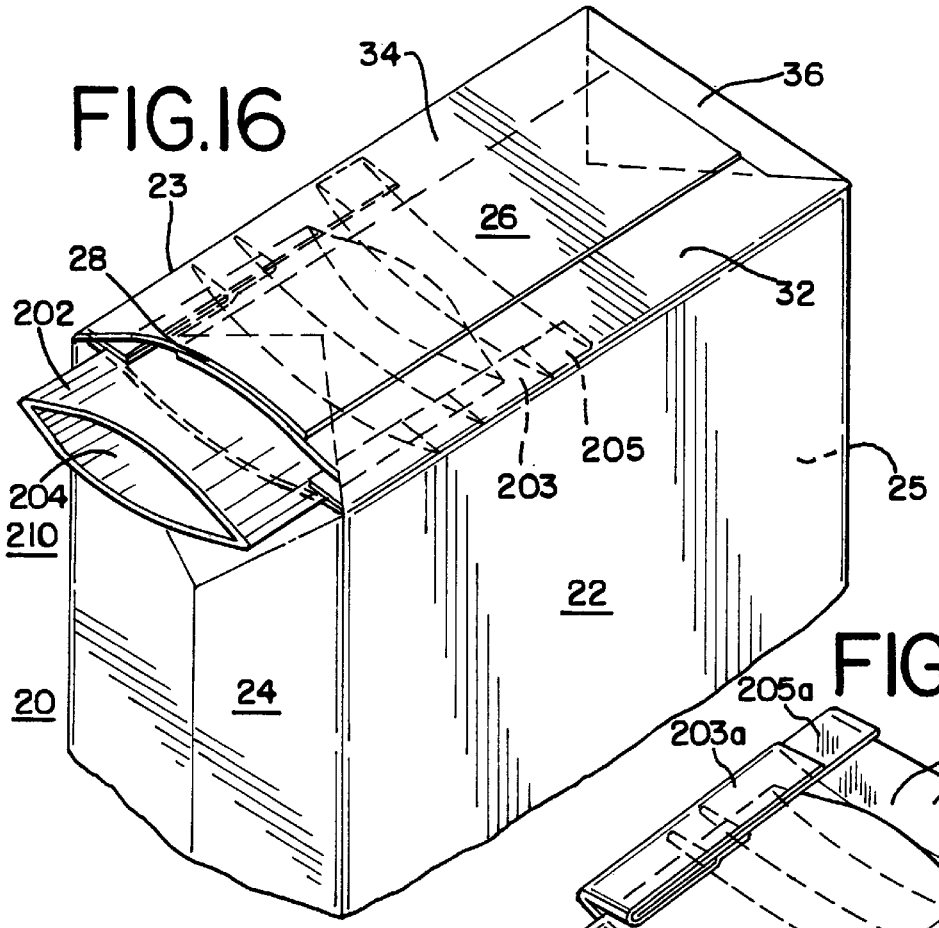
FIG.16A
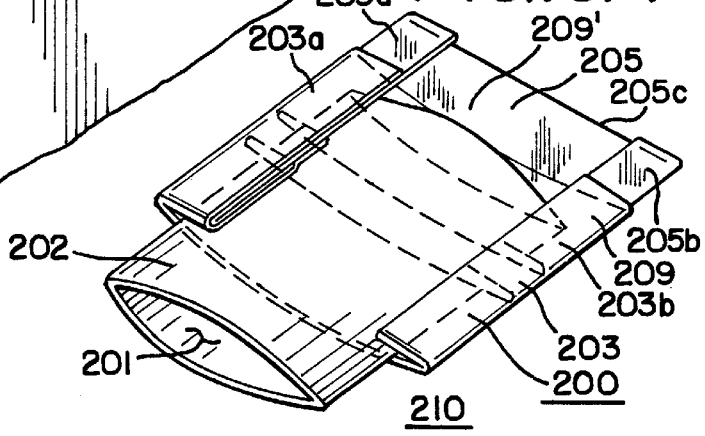
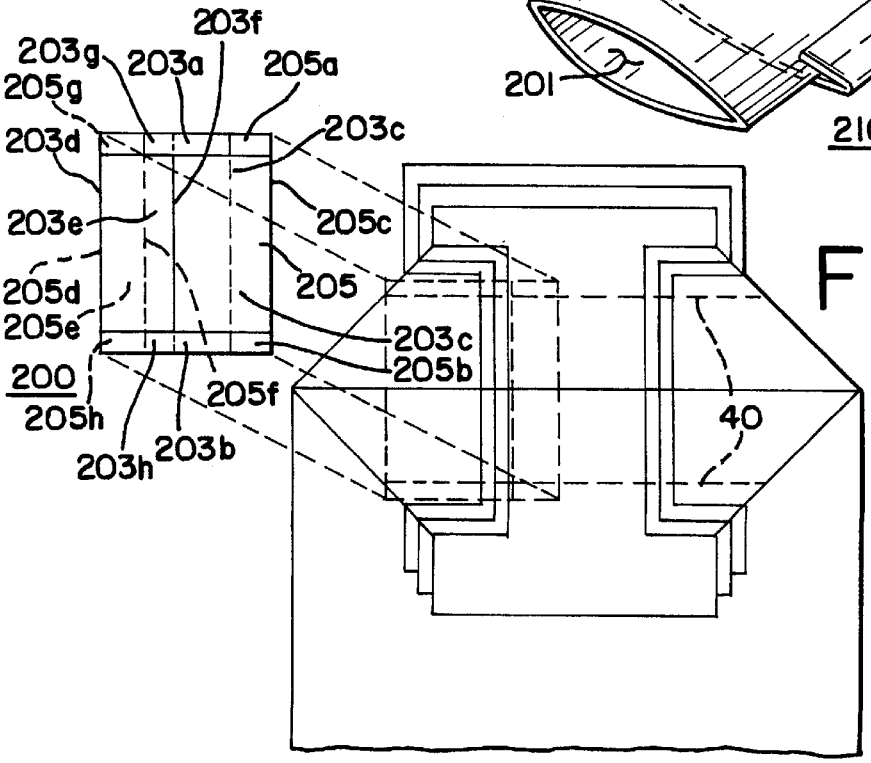
FIG.17

SONIC VALVE CLOSURE ASSEMBLY FOR VALVE BAGS

RELATED APPLICATION

This is a continuation-in-part application of application Ser. No. 08/906,463 filed Aug. 5, 1997, claiming the benefit of U.S. Provisional Application Serial No. 60/025,462, filed Sep. 5, 1996.

BACKGROUND OF THE INVENTION

The present invention relates to valve bags that feature a self-closing valve which closes in response to pressure from the contents of the bag after filling. The contents are typically a powdered or granular medium. A valve bag is a container made with one or more tubular plies of material, the material usually being a rigid paper such as kraft paper. Typically, the valve bag ends are formed by cutting and folding the plies, thereby forming flaps on the long sides of the bag end. Flaps are also formed on the short sides of the bag end. The short flaps are folded inward and the long flaps are folded over each other on top of the short flaps, thus forming the end of the bag. These flaps may be glued or heat bonded together to seal the end of the bag. The bag is usually folded to form gussets extending from both short sides of the bag end resulting in a satchel-type rectangular configuration. These gussets may be folded inward or outward from the sides of the bag. When the bag is filled, these gussets unfold and cause the bag end, top or bottom, to take the rectangular shape. This type of bag is usually called a gussetted satchel bag.

A valve bag is most often a satchel bag which features a channel formed on one of the short sides of the filling end of the bag. This channel is typically a flattened tube which is inserted during bag manufacturing on one side of the bag end before the flaps are folded and sealed together. The channel may also be formed by leaving the two flaps on the long side of the bag end unsealed to the flap on the short side. The channel and the length of the flap on the short side form a passage, which allows access to the interior of the bag for filling it with contents. The folded short side flap may extend further into the bag than the channel, such as that disclosed in Kelley et al., U.S. Pat. No. 5,516,210, thus providing a closure or shutoff for the valve. The valve is closed by the contents of the bag pushing this flap against the sealed long side flaps of the bag end. When the prior art valves are closed, the contents of the bag are supposed to be prevented from sifting out of the channel. Thus, there is no need to immediately heat or sonically seal the bag after it is filled. This allows the bag to be sealed at another location on the production line in the filling process of the bag user.

The main goal of prior art sealable valve bags has been to prevent the sifting or leakage of the bag contents back through the channel of the valve after filling. This goal was addressed by the initial mechanical closing or sealing of the valve in order to prevent such sifting or leaking. Known sealable valve bags have utilized a valve formed from a flattened tube. This tube usually extends outward from the short side of the bag end in order to provide an adequate length of material for the sealing process. For the final sealing closure, the inner surface of the tube is typically coated with an adhesive or other sealing material, which may be activated by heat, pressure, or ultrasonic means. Other valve bag constructions rely on hot melt glue to provide a final seal to the valve. When the packer is ready, valve bags are filled by means of a filling nozzle which is inserted into the valve channel. When the bag is full, the nozzle is removed and the valve opening is then ready to be finally sealed.

While some of the sifting problems have been prevented by these previously used sealable valve bags, they still have limitations inherent in their structure. Sifting and spillage may yet occur when the filling nozzle is removed. This is partially due to the memory of the rigid valve material after removal of the nozzle. Prior art bags which were to be finally sealed at a remote location down the manufacturing line, distant from the filling point, spilled out product between these two stages of the process. Even valve bags which have had an extended short side flap in order to close off the valve channel, nonetheless have still allowed sifting around the sides of this flap, resulting in spillage through the valve opening during transport to the final sealing station. This spillage also affects the seal quality by contaminating any opposing sealing surfaces prior to the sealing process. Furthermore, since the prior art valve constructions have typically utilized only the plies of the bag to support the valve tube, they have been susceptible to tears or damage during the filling process.

It is therefore an object of the present invention to provide a sealable valve bag assembly, which upon filling, immediately creates a mechanical seal lock along the standard parallel fold lines of a satchel-type bag end at the bag-inward opening of the valve tube, thereby sealing both sides of the valve tube in the fold lines and eliminating any possible channeling of the bag contents through and alongside the valve tube prior to a final sealing step.

It is a further object of the present invention to provide a seal tab lock which extends beyond the innermost edge of the short side flap of the bag, thus creating a flap valve which purposely prevents filled product from escaping back out the valve tube before the valve is ultimately sealed by heat, sonic, pressure, adhesive means, or the like.

It is still another object of the present invention to provide a seal tab lock which is attached to the valve bag assembly, but not formed from the valve bag plies, thus adding strength and support to the valve side of the bag end in order to prevent tears or ruptures in the valve area during and after the filling operation.

SUMMARY OF THE INVENTION

The present invention is a valve closure assembly, preferably sonically sealable, for use in valve bags. The valve bag is a container formed from tubular-shaped plies of material, the ends of the bag being formed by cutting the bag material at the corners of the bag end and folding short sides of the bag end inward, thus creating two flaps along long sides of the bag end. A seal tab lock is disposed and affixed on one of the short sides of the bag end where the valve will be located, the seal tab lock also being positioned over the parallel fold lines of the long side flaps of the bag end and extending past both fold lines by an equal length. The seal tab lock is also positioned so that it extends over the inner edge of the longest corner infold of the short side of the bag end. A valve tube is disposed and affixed over the seal tab lock and offset by a predetermined distance so that the seal tab lock extends further into the inner portion of the bag than the inside end of the valve tube. This offset also results in the valve tube extending outwardly from the short side of the bag end. The long side flaps on the bag end are then folded over each other at the parallel fold lines and sealed so that the bag end is formed with the valve tube exposed from one side of the bag end.

Upon filling the bag with the intended product, the seal tab lock, which is affixed to the short side of the bag end before the valve tube is affixed, and also before the long side flaps are folded inward and sealed, forms a barrier around the sides of the inner valve tube end and a mechanical closure for the valve tube inside the bag. The side barrier is formed by extended portions of the seal tab lock inside the bag and along the parallel folds formed by the long side flaps on the bag end. When the long side flaps are folded inward, the extended portions are also folded over, thus creating the seal lock. The offset positioning of the valve tube in relation to the seal tab lock results in the seal tab lock extending further into the bag than the inner valve tube opening, thereby creating a flap valve closure action, which effects a valve tube closure prior to sealing.

In a preferred embodiment of the invention, the width of the seal tab lock equals the width of the valve size specified plus one inch for use with a full width valve. A seal tab lock may also be specified for a reduced valve by providing a wider seal tab lock. Preferably, the width of the seal tab lock will allow enough material to fold over the valve tube in order to create seal tabs along the sides of the valve tube. The valve tube material is preferably a heavy paper, or other rigid material, which allows for easy insertion of a filling nozzle. The heavy paper also prevents tearing or damage to the valve tube during or after the filling process. The inside surface of the valve tube is preferably pre-coated with a sealable material to allow sealing of the valve tube by heat, sonic, pressure, adhesive means, or an equivalent.

BRIEF DESCRIPTION OF THE INVENTION

FIG. 16 is a perspective view of a satchel end of an assembled multiple ply valve bag at the bag end having another alternate embodiment of the valve assembly.

FIG. 16A is a perspective view showing the alternate embodiment of the valve assembly of FIG. 16 removed from the valve bag.

FIG. 17 is a plan view of the bag end having the alternate embodiment of the valve assembly of FIG. 16 showing the assembly placement step for the seal tab lock shown exploded away and in dashed lines with respect to the flaps and parallel fold lines of the bag end.

DETAILED DESCRIPTION OF THE INVENTION

Figure 1:
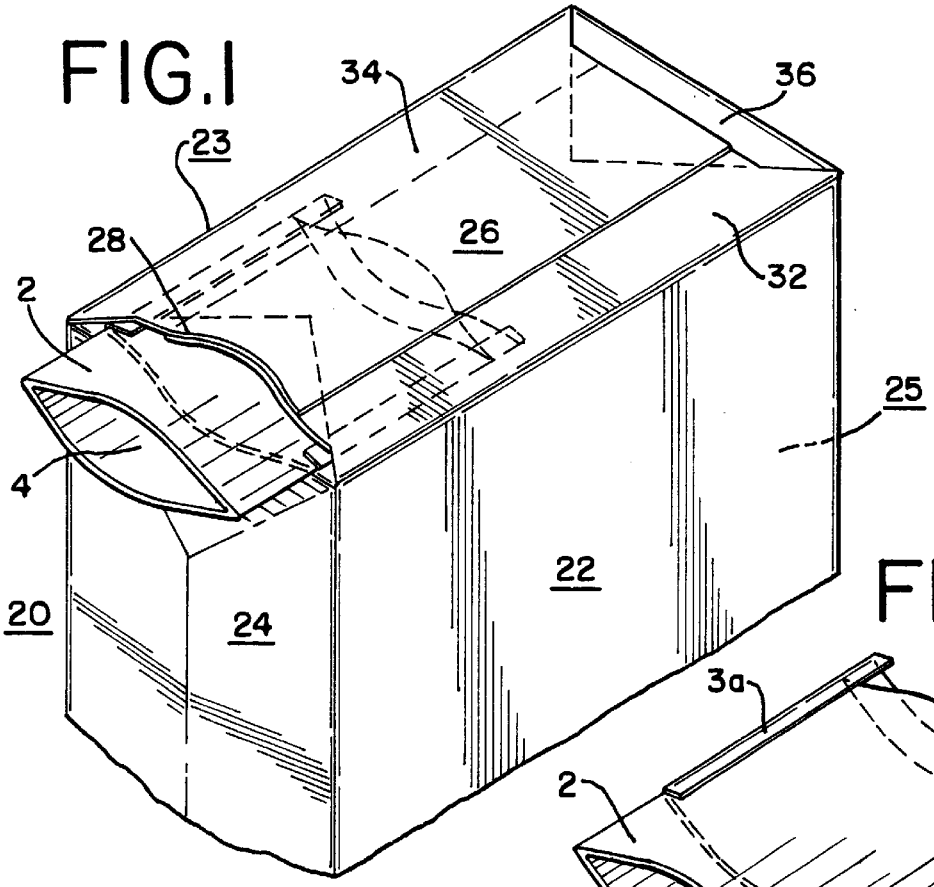
FIG. 1 is a perspective view of a satchel end of an assembled multiple ply valve bag at the bag end having the valve assembly.

A typical valve bag 20 has a tubular configuration with long sides 22 and 23, and short sides 24 and 25, as shown in FIG. 1. For simplicity of illustration, only one bag end 26 with a valve assembly 10 is shown. After final assembly of the valve bag 20, a valve tube 2 extends from the valve side 28 of the bag end 26 and provides a valve channel 4 in order to access the inside of the valve bag 20. The valve bag 20 is usually constructed with one or more paper plies A, B, and C, and is provided with a step pattern 60 at the bag end 26 as illustrated in FIG. 2.

Figure 2:
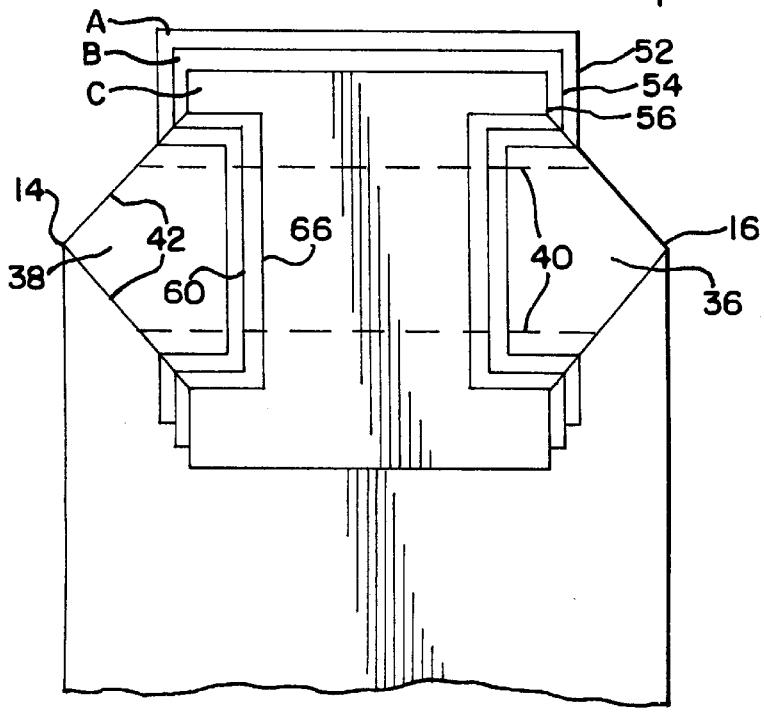
FIG. 2 is a plan view of the unassembled valve bag end of FIG. 1 showing the long side flaps of the multiple bag plies formed by cutting the corners of the valve bag and the short side flaps of the multiple bag plies folded inwardly.

The first step of the sonic valve bag construction depicted in FIG. 2 is to cut the paper plies A, B, and C of the bag end 26, thus creating cut lines 52, 54, and 56. The step pattern 60 is exposed at the short sides 24 and 25 of the bag end 26 by cutting away a portion of the bag ply A, also as shown in FIG. 2. Short side flaps 36 and 38 are folded inward, creating fold lines 42 at the short sides 24 and 25 of the bag end 26 and also creating flaps 32 and 34 along the long sides 22 and 23 of the bag end 26. Parallel fold lines 40 are created to allow the flaps 32 and 34 to fold inward during the final assembly. This construction creates a known type of satchel bag end with outwardly folded gussets 14 and 16 formed by the fold lines 42 at the short sides 24 and 25 of the bag end 26. When the bag 20 is filled with contents, gussets 14 and 16 unfold and cause the bag end 26 to take a rectangular shape.

Figure 3:
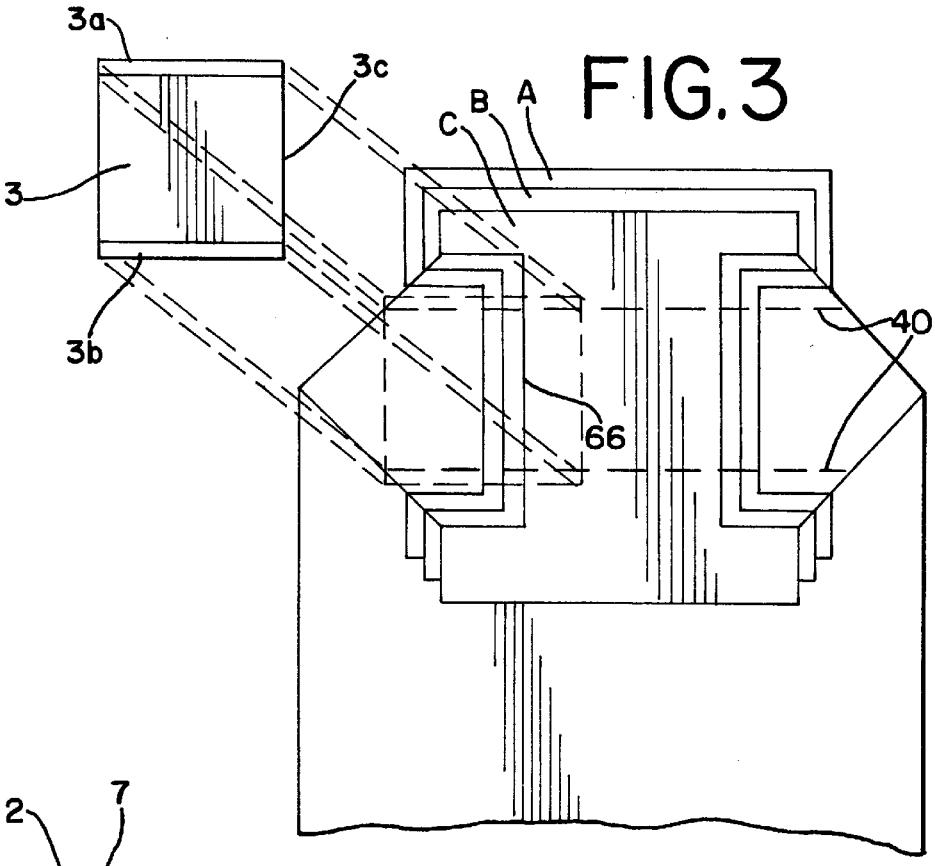
FIG. 3 is a plan view of the bag end having the valve assembly showing the assembly placement step for the seal tab lock shown exploded away and in dashed lines with respect to the flaps and parallel fold lines of the bag end.

A seal tab lock 3 is disposed on the short side flap 38 as shown in FIG. 3 and is centered upon the fold lines 40, so that an equal length of the seal tab lock 3 extends over each fold line 40, thus creating folded-over tab locks 3*a* and 3*b*. The seal tab lock 3 is further disposed so that an inner edge 3*c* extends over an innermost edge 66 of the short side flap 38 by a predetermined distance, this distance being about two inches in the preferred embodiment. This inward extension distance can be longer if the filling nozzle opening 82 shown in FIG. 10 allows, but preferably is no less than about one and one half inches. The seal tab lock 3 in the preferred embodiment is a 50 pound per 3000 sq. ft super (high) performance kraft (SPK) paper. The seal tab lock 3 may be formed from the same material as the plies of the bag 20.

Figure 4:
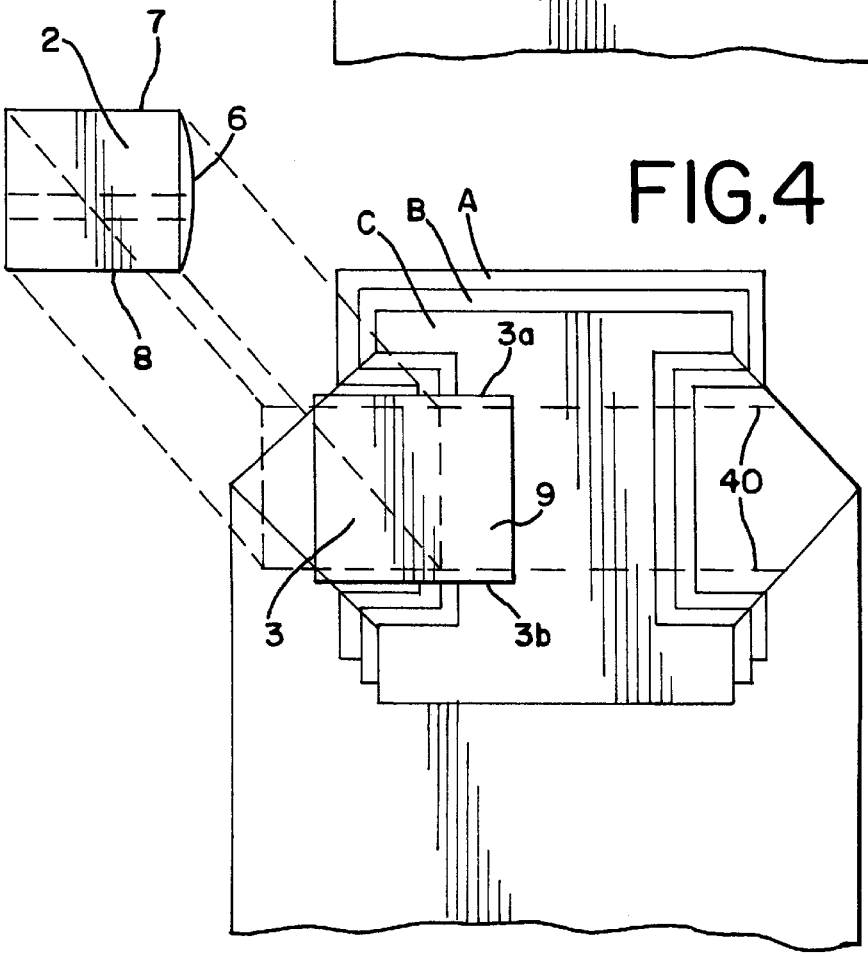
FIG. 4 is a plan view of the bag end having the valve assembly showing the assembly placement step for the sonic valve tube shown exploded away and in dashed lines with respect to the seal tab lock and the parallel fold lines of the bag end.

A valve tube 2 is then disposed on the seal tab lock 3 and positioned such that the valve tube 2 is offset toward the valve side 28 by a predetermined distance, allowing the inner portion of the seal tab lock 3 to extend past the inner opening 6 of the valve tube 2 and creating a flap valve 9 portion of the seal tab lock, 3, as shown in FIG. 4. The offset distance in the preferred embodiment is one quarter inch towards the valve side 28 from the innermost edge 66 of the short side flap 38, plus or minus one quarter inch. The length of the valve tube 2 is dictated by the satchel size of the valve bag 20 and the sealing equipment requirements. The material of the valve tube 2 is preferably a heavy paper, or other rigid material, such as a 70 pound per 3000 sq. ft. natural kraft paper, or equivalent. An example of a suitable alternative material for the valve tube 2 is 60 pound per 3000 sq. ft. bleached white kraft paper. The invention is not limited to forming the valve tube 2 or the seal tab lock 3 only from paper as other suitable materials are envisioned, including plastic polymers.

An inside surface 1 of the valve tube 2 is coated with a special blend of coatings for use in the sealing process. The preferred coating for ultrasonic sealing is polyethylene applied in the proportion of about 40 to 50 pounds of coating per ream of paper. The preferred formulation for the polyethylene coating has the proportion of about 40% ±5% by weight of low density polyethylene with metallocene and about 60% ±5% by weight of high density polyethylene. The coating may also include an anti-static ingredient. An example of a suitable alternative coating is #1652 slip additive resin, sold under the brand name SURLYN by E.I. DuPont deNemours Chemical Company. To prevent curling, the outer surface of the seal tube may be coated with an anti-curling coating. Other coatings may be used for different sealing processes. The valve tube 2 may be coated with other equivalent sealing compositions that may be alternatively sealed through heat, adhesive, or pressure means, as would be understood by those skilled in the art.

Figure 5:
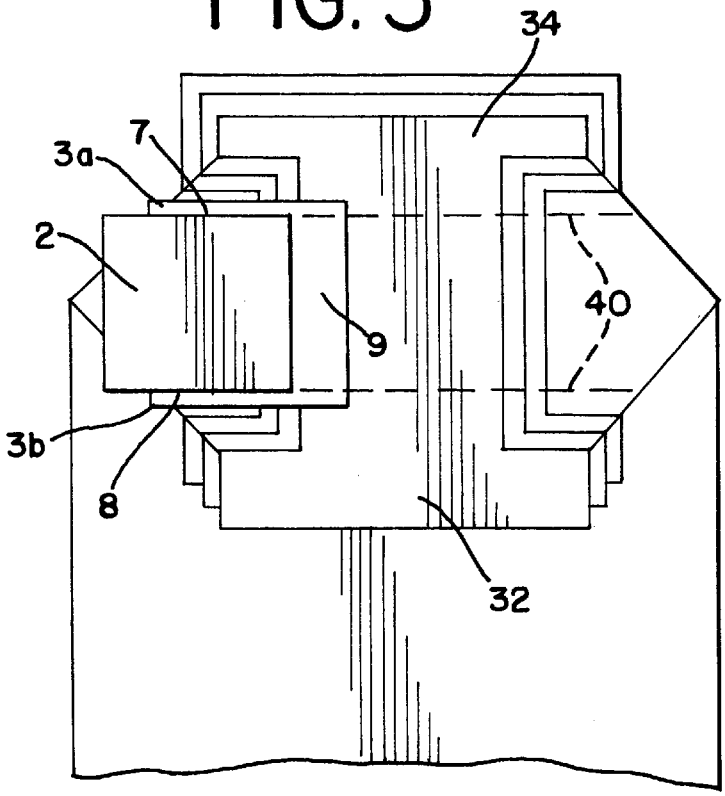
FIG. 5 is a plan view of the bag end having the valve assembly showing a full width valve assembly shown prior to the folding of the long side flaps of the bag end.

FIG. 5 shows the seal tab lock 3 and the valve tube 2 affixed to the short side flap 38 of the bag end 26.

Figure 6:
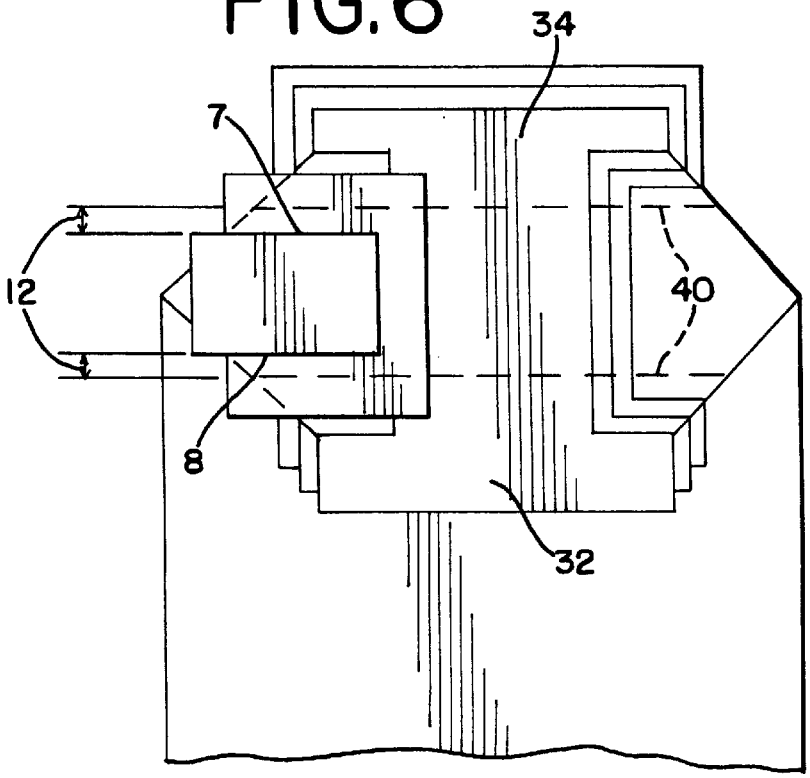
FIG. 6 is a plan view of the bag end similar to FIG. 5 and having a valve assembly in an alternate embodiment for a reduced size valve assembly shown prior to the folding of the long side flaps of the bag end.

FIG. 6 shows the seal tab lock 3 and the valve tube 2 formed in different dimensions, affixed to the short side flap 38 of the bag end 26, thereby forming a reduced size alternate embodiment of the valve assembly 10. The width of the seal tab lock 3 for a full width valve in the exemplary embodiment is determined by adding one inch to the width of the valve tube 2. For standard 40–60 pound capacity paper valve bags, the full width valve manufacturing range is from about three to about nine inches. The width of the seal tab lock 3 for a reduced valve in the disclosed embodiment is determined by adding the width of the bag end 26 to the difference between the width of the bag end 26 and the width of the specified reduced valve tube 2, plus one inch. The extra width in this formula is for the purpose of providing enough material for the seal tab lock 3 to cover widest gaps 12 between sides 7 and 8 of the valve tube 2 and the parallel fold lines 40, as shown in FIG. 6. The reduced valves have a manufacturing range from about three to about eight and three quarter inches for the disclosed alternate embodiment.

Figure 1A:
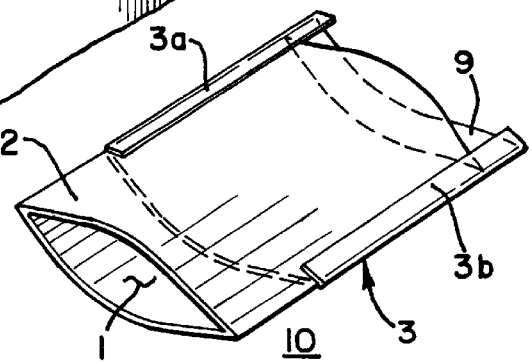
FIG. 1A is a perspective view showing the valve assembly removed from the valve bag.

In the final steps of assembly, the flap 32 is folded inward over the valve tube 2 and the flap 34 is folded over the flap 32 along the fold lines 40, thereby resulting in the tab locks 3*a* and 3*b* of the seal tab lock 3 being folded around and on top of the valve tube 2, as shown in FIG. 1. FIG. 1A shows an isolated view of the assembled valve tube 2 and seal tab lock 3 showing the tab locks 3*a* and 3*b* of the seal tab lock 3 folded around the valve tube 2. In the preferred embodiment, the tab locks 3*a* and 3*b* are integrally joined to the side edges of the seal tab lock 3 and wrap around or over the top of the valve tube 2 for one half inch margins along each side. This provides a complete seal under the valve tube 2 and along the parallel fold lines 40, leaving no channel for the contents to leak out. The flap 34 is then sealed to the flap 32, preferably by pasting, as is known in the bag-making arts, to complete the assembly. The tab locks 3*a* and 3*b* create a seal around the inner opening of the valve tube 2 which, along with the flap valve 9, prevent outward channeling or sifting of the contents of the valve bag 20 during and after the filling process.

Figure 8:
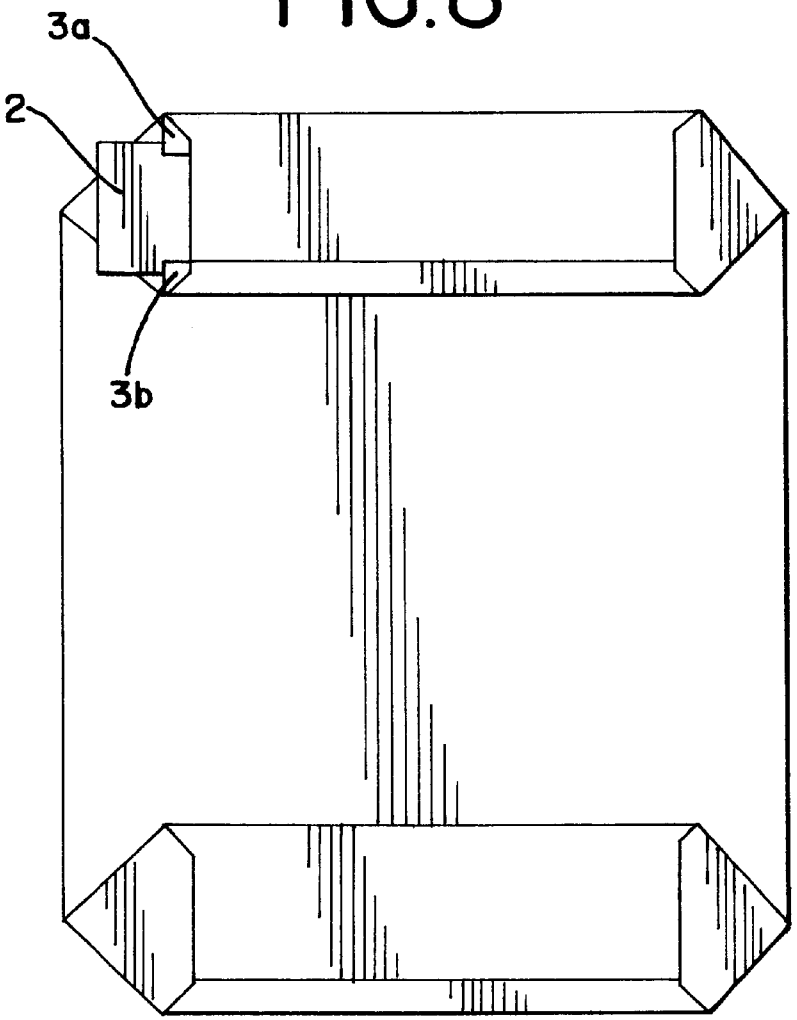
FIG. 8 is a plan view of an entire assembled valve bag with a reduced width valve assembly.
Figure 7:
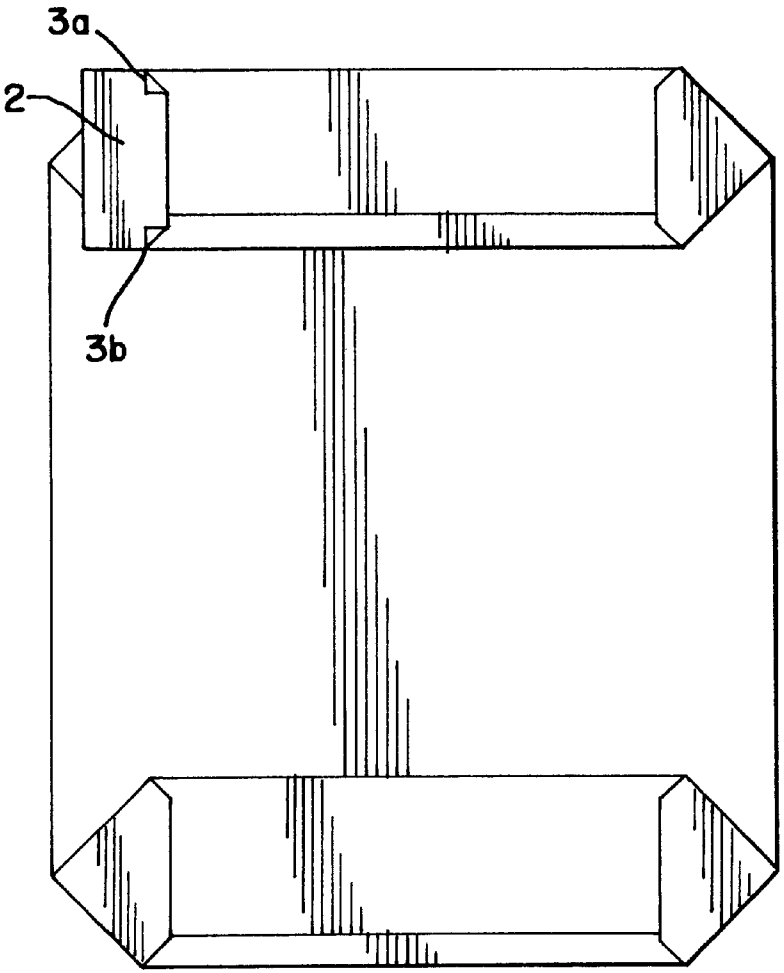
FIG. 7 is a plan view of an entire assembled valve bag with a full width valve assembly.

FIG. 7 and FIG. 8 are plan views of the preferred embodiments for the final assemblies of the full width valve version and the alternate reduced valve version of the valve bag 20, respectively.

Figure 9:
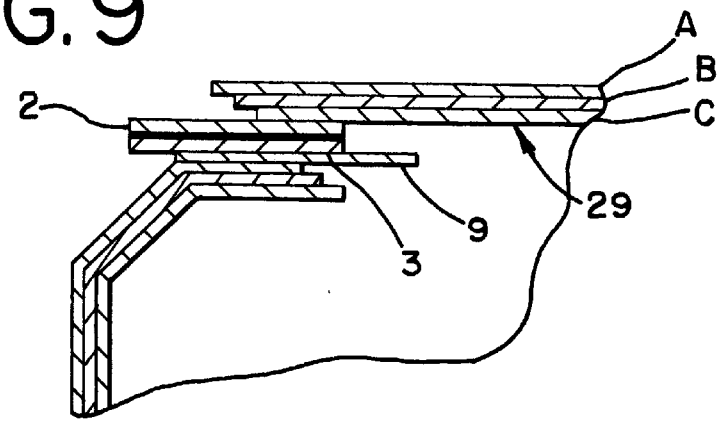
FIG. 9 is a cross-sectional side view of the bag end at the valve assembly before filling.
Figure 10:
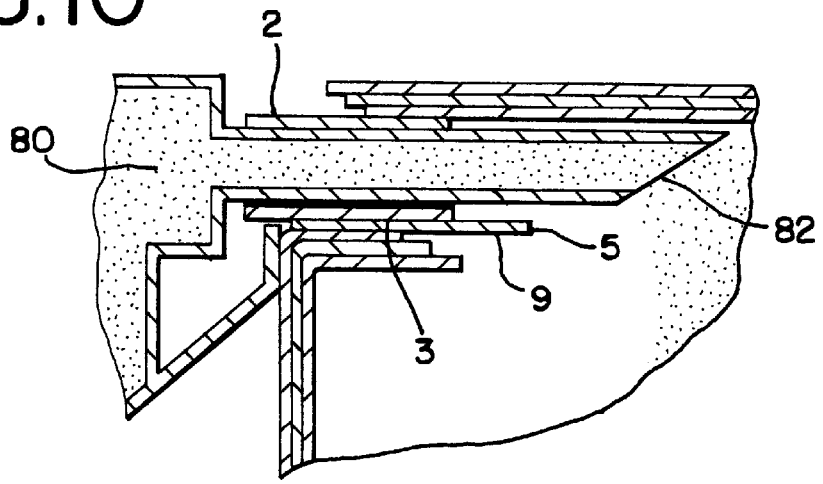
FIG. 10 is a cross-sectional side view of the bag end at the valve assembly during filling by the fill nozzle inserted into the valve.

FIG. 9 is a vertical cross-section taken at the valve side 28 of an assembled empty valve bag 20 ready to be filled. The cross-section reveals the paper plies A, B, and C of the valve bag 20, however the invention is not limited to bags having three plies. The valve tube 2 is shown in a closed but unsealed position with the flap valve 9 of the seal tab lock 3 in an open position. The valve bag 20 is filled by inserting a filling nozzle 80 into the valve channel 4 of the valve tube 2, expanding it open, as shown in FIG. 10. The filling nozzle 80 extends past both the inner opening 6 of the valve tube 2 and an inner edge 5 of the flap valve 9. The valve bag 20 is then filled with contents 100, which would typically be a granular, powdered, or comminuted product, such as dry powdered milk. As the contents 100 inside the valve bag 20 reach the filling nozzle 80, they push flap valve 9 towards the inner surface of the bag end 26. When filling is complete and the filling nozzle 80 is removed, the pressure from the contents 100 of the valve bag 20 forces the flap valve 9 and the tab locks 3*a* and 3*b* against the inner surface 29 of the bag end 26, thereby providing a mechanical closure or shutoff of the inner opening 6 of the valve tube 2. The valve tube 2 is also flattened against the inner surface 29 of the bag end 26 from the pressure of the contents. When the filling nozzle 80 is removed, the tab locks 3*a* and 3*b* of the flap valve 9 prevent the contents from channeling or leaking around the flap valve 9 and sifting back outwardly of the valve channel 4 of the valve tube 2, thus providing an effective closure between the sides 7 and 8 of the valve tube 2 and the inside of the valve bag 20 prior to final sealing of the valve tube 2.

Figure 11:
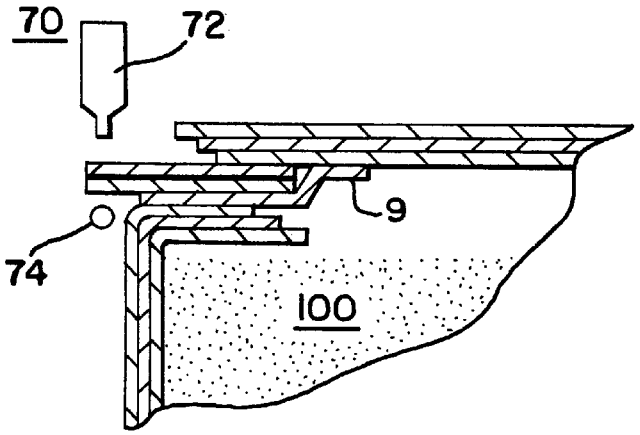
FIG. 11 is a cross-sectional side view of the bag end at the valve assembly showing a filled valve bag and sonic sealing apparatus for sealing the valve closed.

In the disclosed embodiment, the final sealing is illustrated in FIG. 11 and comprises a sonic sealing process performed by a sealing apparatus 70 located on the manufacturing line. The valve bag 20 can be transported to the sealing apparatus 70 via a conveyor system. Sifting and spillage of the contents of valve bag 20 are prevented during the transfer to the sealing apparatus by the function of the tab locks 3*a* and 3*b* and the flap valve 9 as described. The prevention of such spillage allows bags from several filling lines to be transported to distant sealing apparatus stations or other handling procedures. This eliminates the requirement of having a sealing apparatus on each filling line. The sonic sealing of the valve bag 20 may be performed by a typical sealing apparatus 70, such as generator head 72 and anvil 74 shown in FIG. 11. The valve tube 2 extends outwardly from the valve side 28 allowing ample material for the valve tube 2 to be sealed by the sealing apparatus 70 alongside the valve bag 20, as also depicted in FIG. 11.

Figure 12:
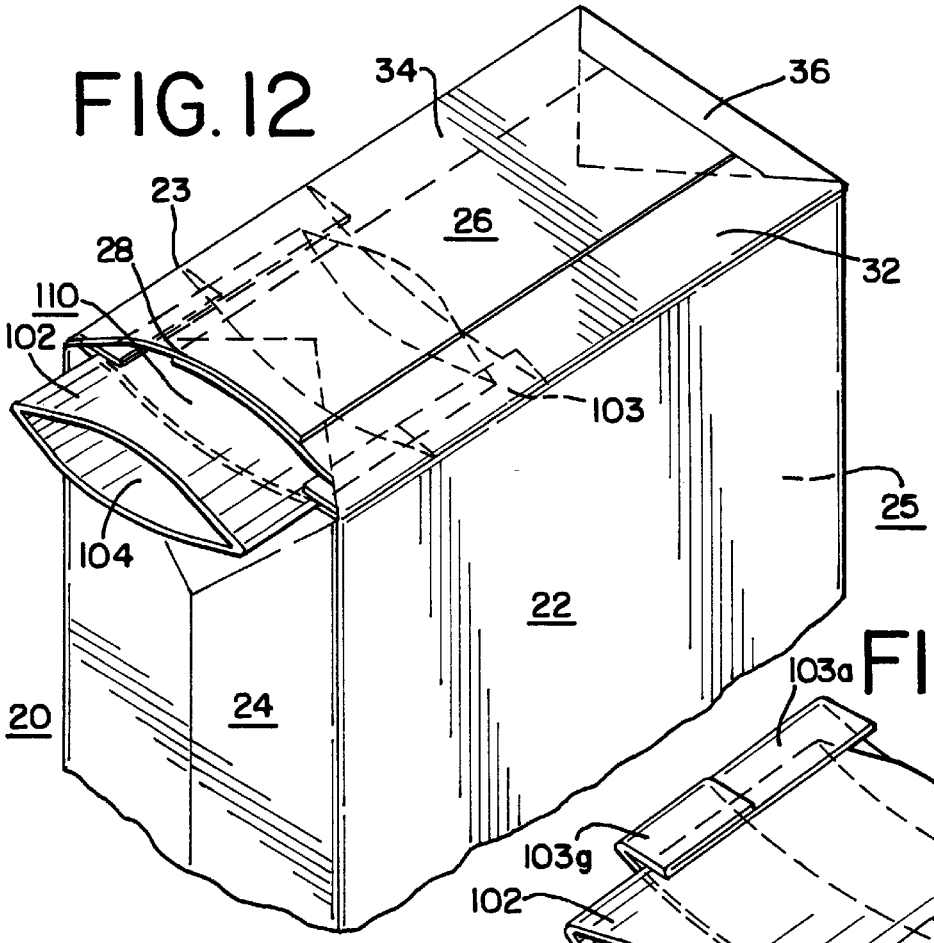
FIG. 12 is a perspective view of a satchel end of an assembled multiple ply valve bag at the bag end having an alternate embodiment of the valve assembly.
Figure 12A:
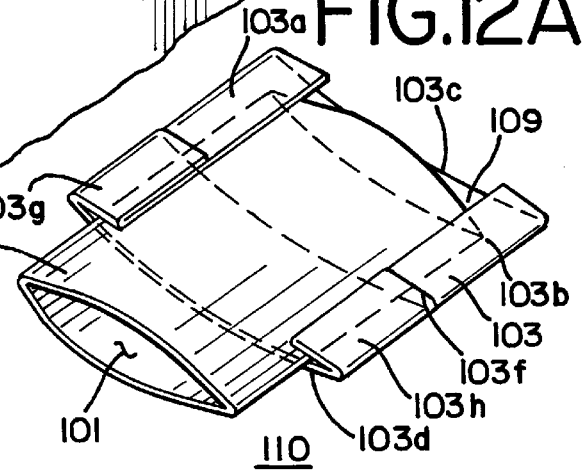
FIG. 12A is a perspective view showing the alternate embodiment of the valve assembly of FIG. 12 removed from the valve bag.
Figure 13:
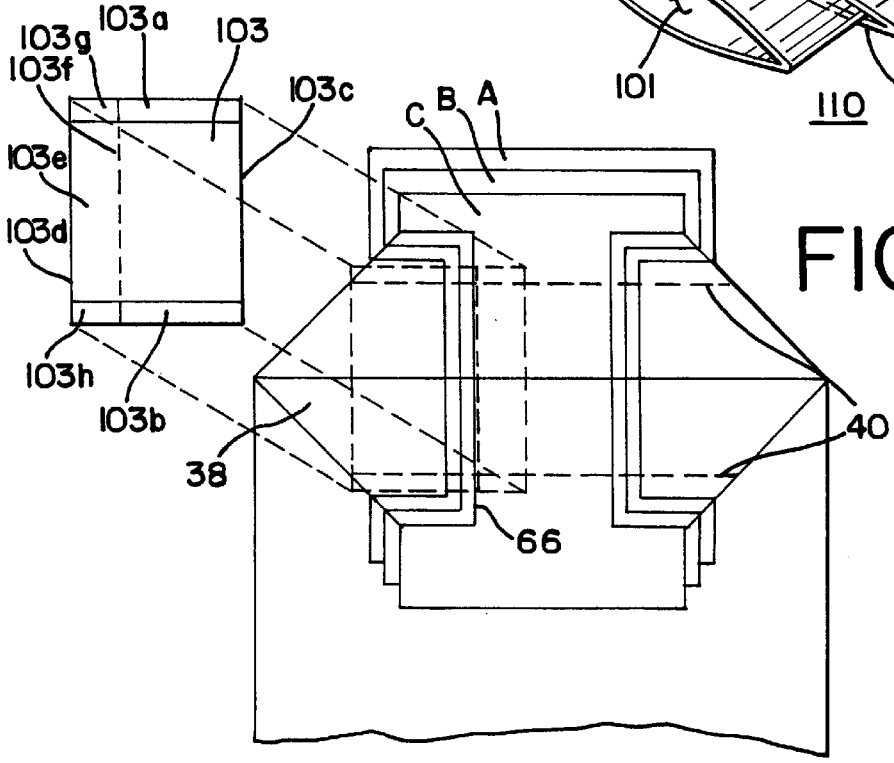
FIG. 13 is a plan view of the bag end having the alternate embodiment of the valve assembly of FIG. 12 showing the assembly placement step for the seal tab lock shown exploded away and in dashed lines with respect to the flaps and parallel fold lines of the bag end.

FIG. 12 shows the assembled valve bag 20 having an alternate embodiment valve assembly 110. FIG. 12A is an isolated view of the valve assembly 110 showing tab locks 103*a*, 103*b*, 103*g*, and 103*h* folded around a valve tube 102. In this embodiment, a seal tab lock 103 is folded under itself along an outside edge 103*d* of the seal tab lock 103 prior to being disposed on the bag 20, thus forming folded portion 103*e* and leading edge 103*f*, as shown in FIG. 13. The folded portion 103*e* and the tab locks 103*g* and 103*h* provide a second, or double, barrier to prevent sifting of material between the folded flaps 32 and 34 of the valve bag 20 and the seal tab locks 103*a* and 103*b* of the valve assembly 110, as well as possible sifting between the seal tab lock 103 and the short side flap 38. The tab locks 103*g* and 103*h* of the folded portion 103*e* also provide added strength to the tab locks 103*a* and 103*b* in order to help prevent tearing during the filling and sealing process.

Figure 14:
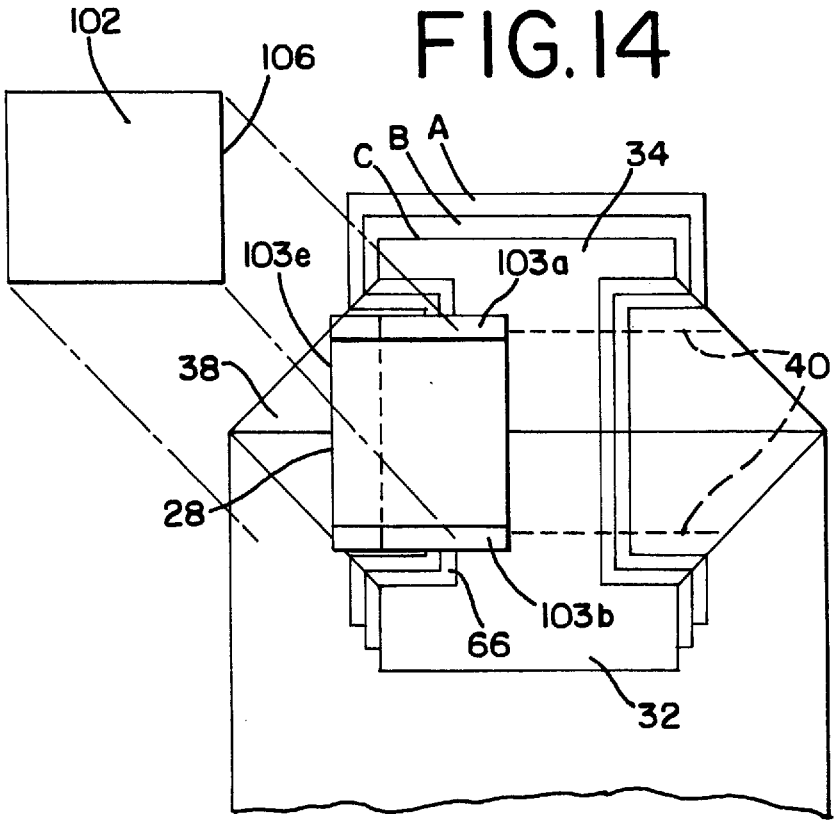
FIG. 14 is a plan view of the bag end having the alternate embodiment of the valve assembly of FIG. 12 showing the assembly placement step for the sonic valve tube shown exploded away and in dashed lines with respect to the seal tab lock and the parallel fold lines of the bag end.
Figure 15:
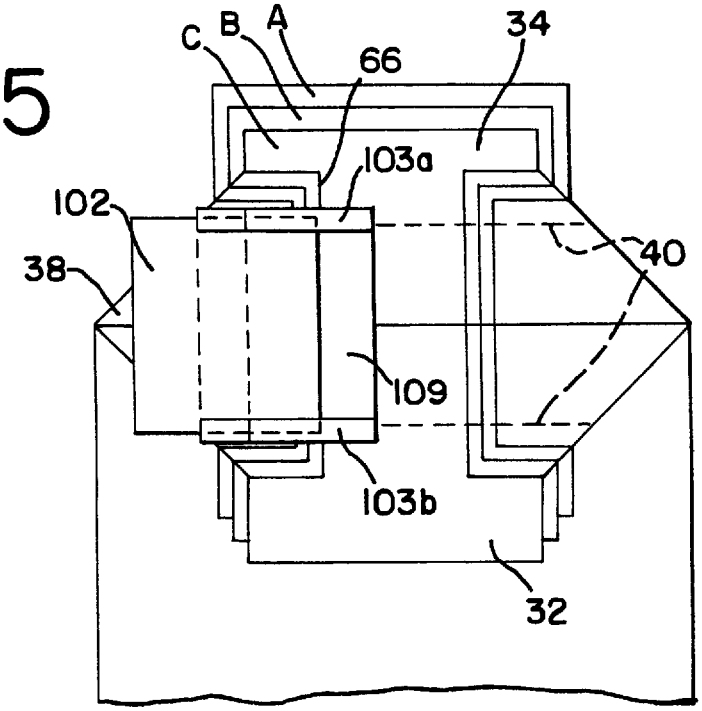
FIG. 15 is a plan view of the bag end having the alternate embodiment of the valve assembly of FIG. 12 showing the valve assembly prior to the folding of the long side flaps of the bag end.

The valve assembly 110 is assembled and attached to the valve bag 20 in much the same way as the other valve assemblies disclosed herein. The seal tab lock 103 with folded portion 103*e* is disposed on the short side flap 38 and is centered upon the fold lines 40, so that an equal length of the seal tab lock 103 extends over each fold line 40, thus creating folded-over tab locks 103*a*, 103*b*, 103*g*, and 103*h*, as shown in FIG. 13. The seal tab lock 103 is further disposed so that an inner edge 103*c* extends over an innermost edge 66 of the short side flap 38 by a predetermined distance, this distance being about two inches in the preferred embodiment. This inward extension distance can be longer if the filling nozzle opening 82 shown in FIG. 10 allows, but preferably is no less than about one and one half inches. The valve tube 102 is then disposed on the seal tab lock 103 and positioned such that the valve tube 102 is offset toward the valve side 28 by a predetermined distance, allowing the inner portion of the seal tab lock 103 to extend past the inner opening 106 of the valve tube 102 and creating a flap valve 109 portion of the seal tab lock 103, as shown in FIGS. 12A, 14 and 15.

FIG. 16 shows the assembled valve bag 20 having yet another alternate embodiment valve assembly 210. The valve assembly 210 utilizes a two-piece seal tab lock configuration 200 consisting of a main layer 203, typically made of paper, and an offset layer 205, typically made of a thin plastic film. The main layer 203 and the offset layer 205 of the two-piece seal tab lock 200 have tab locks 203*a*, 203*b* and 205*a*, 205*b*, respectively, folded around a valve tube 202 in FIG. 16A. FIG. 17 further shows the main layer 203 and the offset layer 205 to additionally have tab locks 203*g*, 203*h*, and 205*g*, 205*h*, respectively, of the two-piece seal tab lock 200. In this embodiment, the offset layer 205 is positioned such that an inner edge 205*c* of the offset layer 205 overlaps an inner edge 203*c* of the main layer 203 of the two-piece seal tab lock 200. This overlap creates a two-layer flap valve 209 up to the inner edge 203*c* and a single layer therepast at 209' comprising the offset layer 205 alone. Typically the offset layer 205 is made of a thin plastic film which provides aid in sealing off the valve when product pressure forces the flap valve 209 and 209' closed. When filling is complete, the pressure from the contents of the valve bag 20 forces the flap valve 209 and 209' against the inner surface of the bag end 26, thereby providing a mechanical closure or shutoff of the inner opening 206 of the valve tube 202. The thin plastic film of the offset layer 205 is very limp and provides for a well-sealed shutoff.

Both the offset layer 205 and the main layer 203 are folded over along their outside edges 203*d* and 205*d* prior to being disposed on the valve bag 20, thus forming folded portions 203*e* and 205*e*, and leading edges 203*f* and 205*f*, as shown in FIG. 17. These portions are first folded over the top of the two-layer seal tab lock 200, unlike the seal tab lock 110 in FIG. 12A where the folded portion 103*e* is first folded under the tab lock 110. Thus, the folded portion 205*e* of the thin plastic film is captured by the folded portion 203*e* of paper. The folded portions 203*e* and 205*e* and the tab locks 203*g*, 203*h*, 205*g*, and 205*h* provide a second, or double, barrier to prevent sifting of material between the folded flaps 32 and 34 of the valve bag 20 and the tab locks 203*a*, 203*b*, 205*a*, and 205*b* of the valve assembly 210, as well as preventing sifting between the seal tab lock 203 and the short side flap 38. The tab locks 203*g*, 203*h*, 205*g*, and 205*h* of the folded portions 203*e* and 205*e* also provide added strength to the tab locks 203*a*, 203*b*, 205*a*, and 205*b* in order to help prevent tearing during the filling and sealing process.

Figure 18:
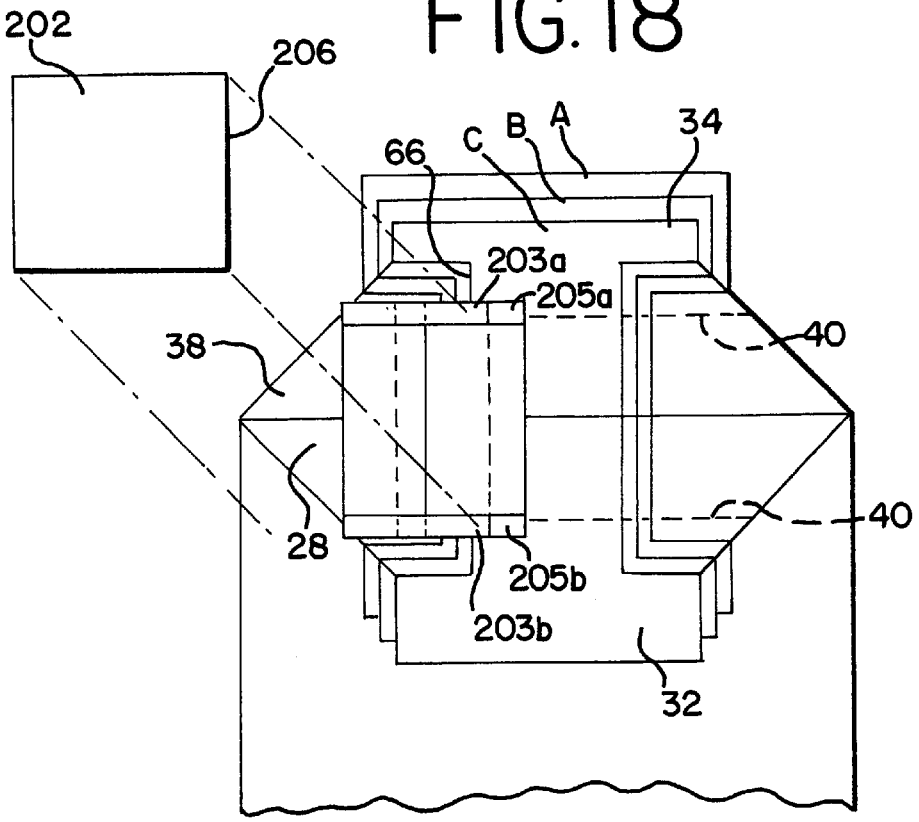
FIG. 18 is a plan view of the bag end having the alternate embodiment of the valve assembly of FIG. 16 showing the assembly placement step for the sonic valve tube shown exploded away and in dashed lines with respect to the seal tab lock and the parallel fold lines of the bag end.
Figure 19:
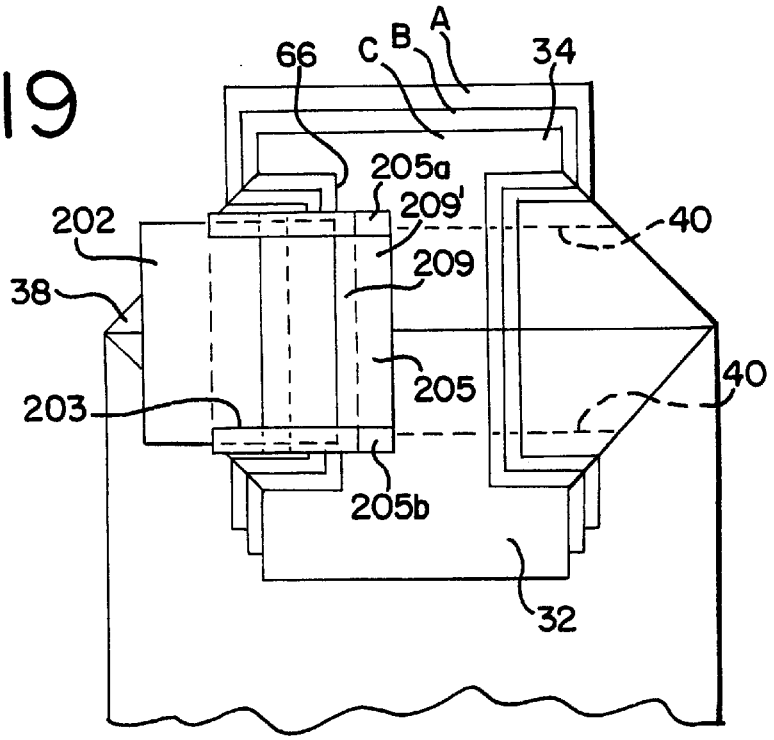
FIG. 19 is a plan view of the bag end having the alternate embodiment of the valve assembly of FIG. 16 showing the valve assembly prior to the folding of the long side flaps of the bag end.

The two-piece seal tab lock 200 with the folded portions 203*e* and 205*e* is disposed on the short side flap 38 as shown in FIG. 17 and is centered upon the fold lines 40, so that an equal length of the two-piece seal tab lock configuration 200 extends over each fold line 40, thus creating the folded-over tab locks 203*a*, 203*b*, 203*g*, 203*h*, 205*a*, 205*b*, 205*g*, and 205*h*. The two-piece seal tab lock 200 is further disposed so that an inner edge 205*c* extends over an innermost edge 66 of the short side flap 38 by a predetermined distance, this distance being about two inches in the preferred embodiment. This inward extension distance can be longer if the filling nozzle opening 82 shown in FIG. 10 allows, but preferably is no less than about one and one half inches. The valve tube 202 is then disposed on the two-piece seal tab lock 200 and positioned such that the valve tube 202 is offset toward the valve side 28 by a predetermined distance, allowing the inner portion of the two-piece seal tab lock 200 to extend past the inner opening 206 of the valve tube 202, thus forming the two-piece flap valve 209, as shown in FIGS. 16A, 18 and 19.

While specific embodiments of the present invention have been shown here for the purposes of explaining preferred and alternate embodiments of the invention, it is to be understood that the appended claims have a wide range of equivalents and a broader scope than the embodiments disclosed.

What is claimed is:

1. A valve bag assembly comprising:

a tubular bag body having a valve end including a valve side, an interior portion and an exterior surface; and a valve having:

a valve tube having an inner opening, an outer opening, an interior surface and an exterior surface, said valve tube disposed at said valve side of said valve end of said tubular bag body, the inner opening extending into the interior portion of said tubular bag body and the outer opening extending outward of the exterior surface of said tubular valve bag, said valve tube providing a channel into the interior portion of said valve bag for filling the bag and the valve tube being substantially gas-impermeable during bag filling; and a flap valve member having an inner edge, an outer edge, and two side edges, said outer edge formed by folding a portion of said flap valve member onto itself, said flap valve member disposed at said valve side of the tubular bag body between said tubular bag body and the exterior surface of said valve tube, the inner edge of said flap valve member extending past the inner opening of said valve tube, and the two side edges each integrally joined to folded-over tab locks, said tab locks being folded over side margins of the exterior surface of the valve tube creating a seal around said inner opening of the valve tube for preventing outward channeling of product from the bag when being filled.

2. The valve bag assembly according to claim 1, wherein said valve tube is made of natural kraft paper.

3. The valve bag assembly according to claim 2, wherein the weight range of said natural kraft paper is from about 60 to 70 pounds per 3000 sq. ft. of paper.

4. The valve bag assembly according to claim 1, wherein said valve tube further comprises an interior surface coating disposed on said interior surface and wherein said interior surface coating is capable of being sonically sealed.

5. The valve bag assembly according to claim 4, wherein said interior surface coating includes an anti-static ingredient.

6. The valve bag assembly according to claim 5, wherein said interior surface coating is polyethylene.

7. The valve bag assembly according to claim 6, wherein said polyethylene has a formulation with about 40%±5% low density polyethylene with metallocene and about 60%±5% high density polyethylene.

8. The valve bag assembly according to claim 1, wherein the tab locks are spaced apart a distance therebetween.

9. The valve bag assembly according to claim 1, wherein said valve end includes two parallel folds extending to meet said valve side and the distance between the two folded portions of said flap valve equals the distance between said two parallel folds of said valve end plus the difference between the width of said valve tube and said distance between said two parallel folds of said valve end, plus at least about one inch.

10. The valve bag assembly according to claim 1, wherein the width of said valve tube ranges from about three inches to about nine inches.

11. The valve bag assembly according to claim 1, wherein the valve side of the bag end includes an outer folded edge and an innermost edge of a bag flap, and the distance between the inner edge and the outer folded edge of said flap valve equals the distance between the outer folded edge of the bag and the innermost edge of said bag flap plus at least about two inches.

12. The valve bag assembly according to claim 1, in combination with a fill spout for filling the bag with product, wherein the valve side of the bag end includes an outer folded edge and an innermost edge of a bag flap, and the distance between the inner edge and the outer folded edge of said flap valve equals the distance between the outer folded edge of the bag and the closest edge of an opening of the fill spout inserted into said valve tube for filling the bag with product.

* * * * *